United States Patent [19]

Price

[11] 3,958,886

[45] May 25, 1976

[54] LOOSELEAF BINDER MECHANISM

[75] Inventor: Roy H. Price, Springfield, Mo.

[73] Assignee: Royal Business Machines, Inc., Springfield, Mo.

[22] Filed: May 13, 1974

[21] Appl. No.: 469,740

Related U.S. Application Data

[63] Continuation of Ser. No. 234,100, March 13, 1972, abandoned.

[52] U.S. Cl. ..... 402/75; 292/147; 292/DIG. 38; 402/44; 402/47

[51] Int. Cl.[2] ..... B42F 13/12; B42F 13/20

[58] Field of Search ..... 402/44, 46, 47, 48, 402/52, 61, 55, 56, 59–69, 71; 281/19 R, 19 A; 292/147, 204, DIG. 38; 24/263 LS, 230 AL; 74/531, 503

[56] References Cited

UNITED STATES PATENTS 2,148,789 2/1939 Linger ..... 402/74

2,791,220 5/1957 McBee ..... 402/44

FOREIGN PATENTS OR APPLICATIONS 407,464 12/1924 Germany ..... 292/147

*Primary Examiner*—Jerome Schnall

*Attorney, Agent, or Firm*—Norman Friedman; Stephen A. Roen; Robert F. Rotella

[57] ABSTRACT

A looseleaf binder mechanism having a pin-and-slot mounted shiftable latching slide provided with novel positive detenting means comprising an elastomeric washer mounted on the pin and cooperable with a protuberance formed on the latching member intermediate the ends of the slot, to thereby hold the latching member detented in its respective shifted end positions.

12 Claims, 8 Drawing Figures

LOOSELEAF BINDER MECHANISM

This is a continuation of application Ser. No. 234,100, filed Mar. 13, 1972, now abandoned.

BACKGROUND OF THE INVENTION

Looseleaf binder mechanisms of various types conventionally include a shiftable latching member, such as a slide, for releasably holding a portion of the paper-holding mechanism latched in assembled position, for example to the binder cover. To prevent the latching member from inadvertently being shifted out of its current shifted position, it is desirable that a suitable detenting mechanism be provided.

U.S. Pat. No. 2,148,789 shows one approach for providing this desirable detenting function. The detenting structure of that patent comprises an elongated tongue struck or sheared from the latching slide member and formed at its outer free end with a detent protuberance. The protuberance is adapted to mate with one or the other of two spaces detent recesses formed in a member adjacent to and relative to which the latching slide moves.

SUMMARY OF THE INVENTION

In accordance with the present invention, there is provided a greatly simplified and therefore less expensive to manufacture form of detent mechanism for the latching member or slide. The present invention incorporates at least a part of the conventional slide mounting means to function as a part of the detenting means. More specifically, the latching slide is as usual mounted for its sliding movement by means of pin-and-slot structure. In the present invention, the pin itself of the pin-and-slot means functions as part of the detenting means. For this purpose, a washer or collar is mounted on the pin. The washer is preferably made of a synthetic resin such as nylon, which will be somewhat elastomeric and will also provide a durable wear characteristic. A detent protuberance is formed in the latching slide intermediate the ends of the slot of the aforementioned pin-and-slot mounting means. This protuberance is preferably in the form of a rib provided by deformation grooving the opposite side of the latching slide.

The protuberance or rib of the latching slide is cooperably engageable with the washer in response to shifting movement of the slide, to press the washer against the usual enlarged head of the mounting pin, and thereby hold the slide detented in both of its shifted positions.

It is therefore a primary object of the present invention to provide a looseleaf binder mechanism latching slide or other equivalent member with a novel detenting means.

It is the further object to provide such a detenting means which is less expensive to manufacture.

It is a further object to provide such a detent mechanism wherein the detenting mechanism includes as a part thereof a portion of the structure mounting the slide for its shifting movement.

It is a further object to provide a detenting means which has a more durable wear characteristic.

The above and other objects, advantages, and features of the invention will be apparent to those of ordinary skill in the art from the following detailed description of certain preferred embodiments of the invention when read in conjunction with the accompanying drawings.

DESCRIPTION OF THE PREFERRED EMBODIMENTS

Figure 6:
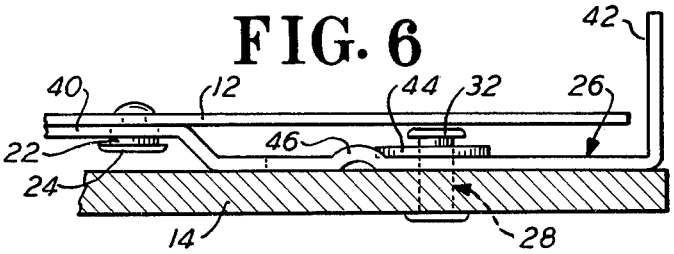
FIG. 6 is a similar view showing the latching slide shifted a still further step of movement to the left and now being in its leftmost or closed shifted position.
Figure 7:
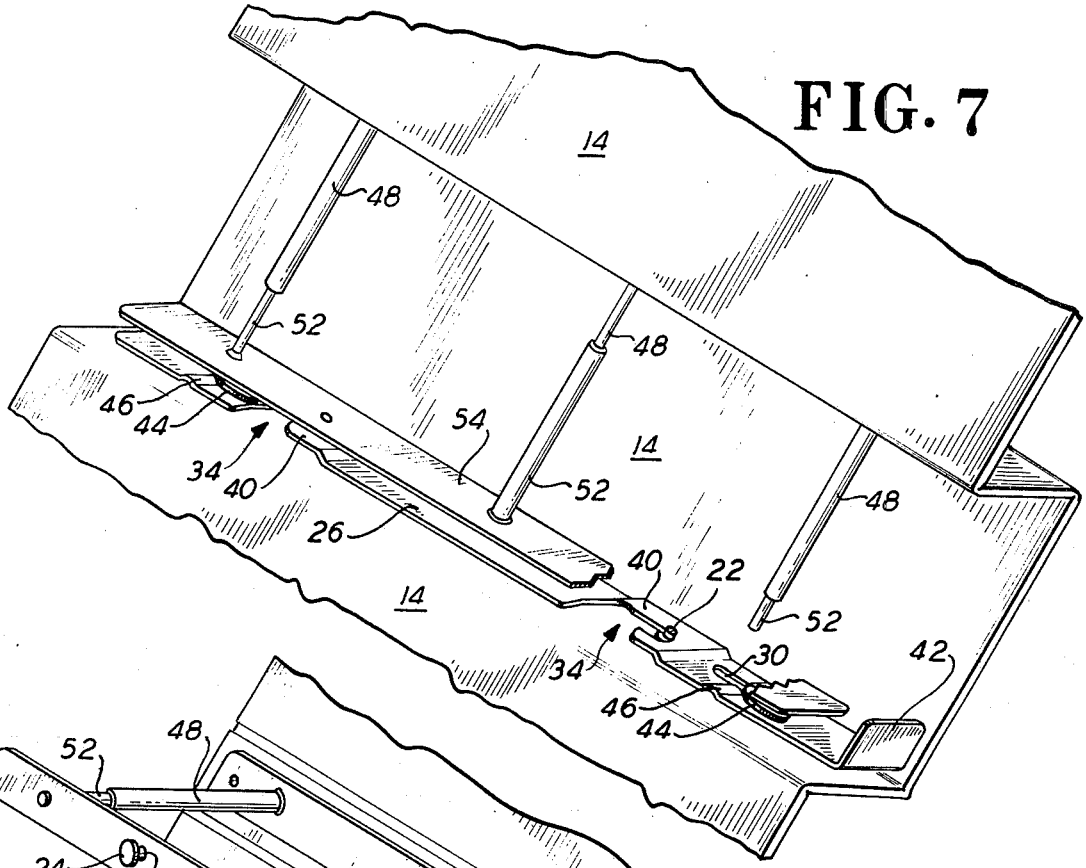
FIG. 7 is a fragmentary perspective view showing the mechanism of the invention applied to another form of looseleaf binder, namely a telescoping post looseleaf binder, with the paper-holding mechanism latched in assembled relation with the latching slide.
Figure 8:
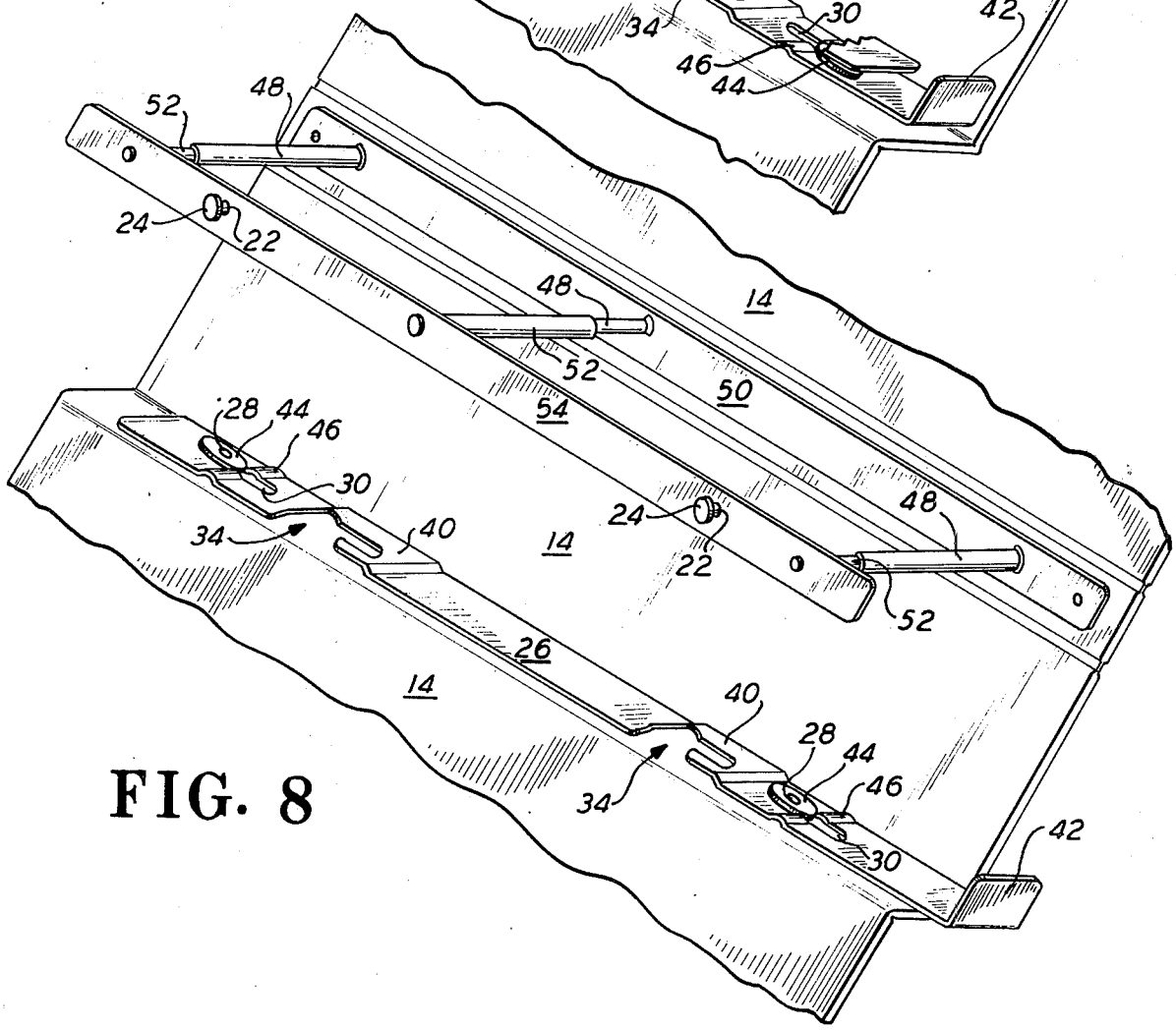
FIG. 8 is a perspective view of the form of FIG. 7, with the paper-holding mechanism unlatched from the latching slide, and with the latching slide in its rightmost or open position.

In the present application, for illustrative purposes the invention is shown in FIGS. 1 – 6 as applied to one conventional form of paper-holding mechanism, and in FIGS. 7 and 8 to another conventional type of such mechanism.

Figure 1:
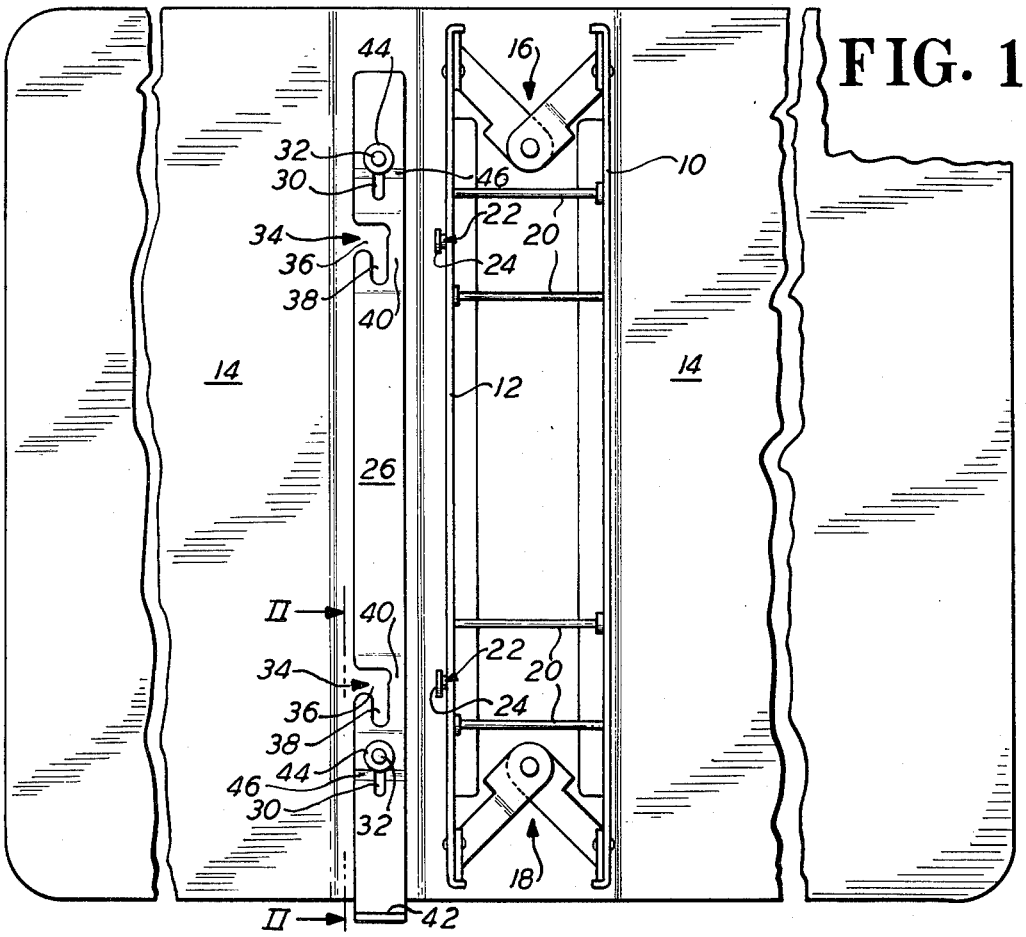
FIG. 1 is a top plan view of one form of looseleaf binder in which the invention can be incorporated, the latching slide being in its lowermost or open position, and the paper-holding mechanism being unlatched from the latching slide.

Referring to FIG. 1, the paper-holding mechanism there shown is of the type disclosed in U.S. Pat. No. 2,791,220 issued to H. B. McBee May 7, 1957. Reference is made to that patent for a detailed disclosure of the structure and operation of that paper-holding mechanism. It will suffice to say here that that such prior mechanism includes two spaced bars 10 and 12, bar 10 being permanently secured to a portion of the binder cover 14 and the other bar 12 being latchable to and removable from the opposed portion of the binder cover. The bars are interconnected at their opposed ends by locking hinge linkage mechanisms 16 and 18, and there are provided prongs or rings 20 for holding the looseleaf paper.

Bar 12 is provided with laterally outwardly extending rivets 22 having enlarged heads 24, by which bar 12 is adapted to be latched to the binder cover 14.

Instead of the latching bar mechanism disclosed in said U.S. Pat. No. 2,791,220, there is provided herein a latching slide 26 (see also FIGS. 2 – 6). The latter is secured and mounted to the binder cover 14 for fore and aft sliding movement by means of pins 28 extending through short elongated longitudinal slots 30 of the latching slide. Each pin 26 includes a slightly enlarged inner head 32. The latching slide 26 is provided with conventional bayonet-type slots 34 having a transverse portion 36 connecting with a right angle longitudinal portion 38. These slotted portions are provided in upwardly offset portions 40 of the slide, to provide clearance thereunder to receive the heads 24 of rivets 22.

In the downward shifted position of the latching slide as seen in FIGS. 1 (rightward in FIG. 2), the bayonet slot transverse portions 36 are aligned with and adapted to receive the locking rivets 22 with the rivet heads 24 lying below the plane of the offset portions 40 of the latching slide. In customary fashion, the latching slide is then pushed upwardly (leftwardly in FIG. 2), by pressing on the lower offset finger piece end 42 of the slide, so as to shift the transverse slot portions 34 upwardly out of transverse alignment with the rivets 22, the longitudinal slot portions 38 riding around the rivet bodies during the course of this movement. The final leftmost latched position is as shown in FIG. 6, with the pins 28 now lying at the bottom (right in FIG. 6) ends of the longitudinal mounting slots 30.

The novel latching slide detent means of the present invention will now be described. As best seen in FIGS. 2 – 6, the upper heads 32 of the pins 28 by which the latching slide 26 is mounted to the binder cover, are spaced a short clearance distance above the adjacent upper surface of the latching slide 26. Mounted on and surrounding each pin body in this clearance space is a small washer or collar 44 substantially free for up and down sliding movement on the pin body within the clearance space. Washers 44 are preferably made of a synthetic resin, preferably somewhat elastomeric material, which will also have a durable wear characteristic, such as nylon. The enlarged heads 32 of pins 28 hold washers 44 on the pins.

It will be recalled that the latching slide 26 includes the short elongated longitudinal mounting slots 30 through which the body of each mounting pin 28 extends. Intermediate the ends of each of these slots, the latching slide 26 is formed with an upward protuberance or deformation which, as shown, may be in the form of a rib 46 provided by deformation grooving of the under surface of the slide. It will also be understood that the respective end shifted positions of the latching slide are determined by the body of each mounting pin 28 abutting the respective opposed longitudinal ends of the slide mounting slots 30.

Figure 2:
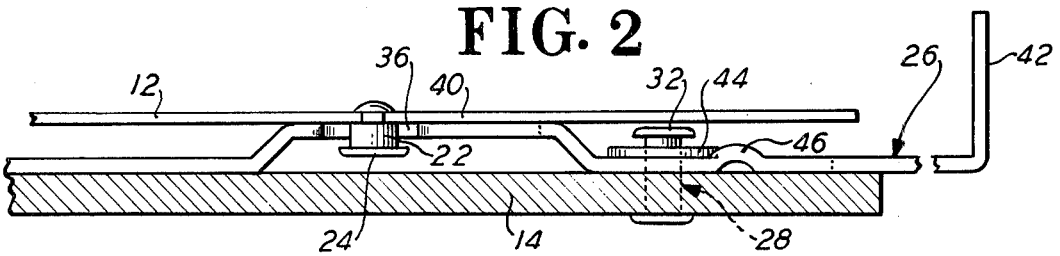
FIG. 2 is an enlarged fragmentary longitudinal sectional view, taken on line II — II of FIG. 1, of the lower end of the latching slide, the paper-holding mechanism being in latchable relation with the latching slide, the slide being in its rightmost or open position.

Therefore, in the course of the shifting movement of latching slide 26 from its open position of FIGS. 1 and 2 to its closed or latched position of FIG. 6, each rib 46 of the slide will likewise sequentially move longitudinally relative to each mounting pin 28 through the various relative positions shown in FIGS. 2 – 6, i.e., from one side of the pin 28 to its other side.

The thickness of the detent washer 44 is such that when rib 46 is vertically aligned with the pin 28 (FIG. 4), the washer will substantially occupy all the then clearance space between the rib and the underside of the pin head 32, and preferably with a slight press fit.

Of course, when rib 46 is aligned with or underlies the pin head 32, this is the minimum clearance condition of the space provided between the latching slide and the underside of the pin head. In the extreme opposite end positions of the latching slide, however, (FIGS. 2, 6) the rib 46 is now longitudinally spaced from the rivet head. Hence, there now exists a greater clearance between the washers 44 and the undersides of the pin heads 32.

The foregoing structure substantially positively detents the slide 26 in both of its end shifted positions.

Figure 3:
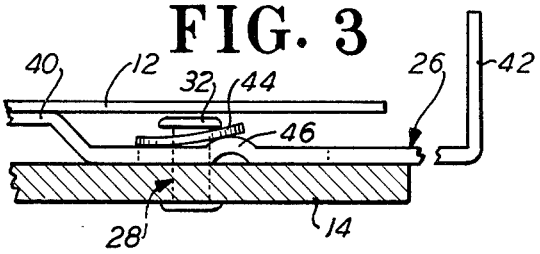
FIG. 3 is a detail view similar to FIG. 2 showing the latching slide shifted slightly toward the left.
Figure 4:
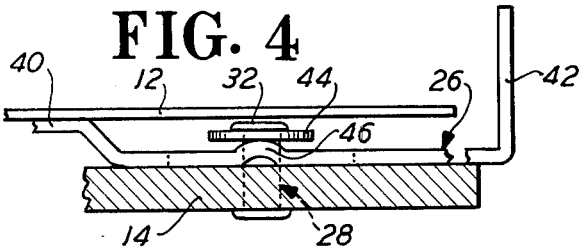
FIG. 4 is a similar view showing the latching slide shifted further to approximately its central position with the detent rib of the latching slide being aligned with the mounting pin.
Figure 5:
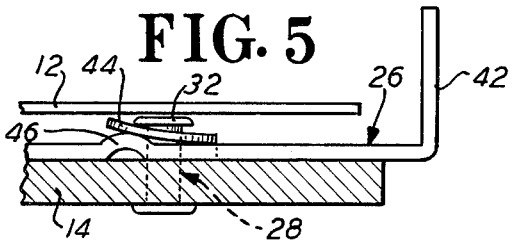
FIG. 5 is a similar view showing the latching slide shifted a still further step of movement toward the left.

For example, when the latching slide 26 is in its rightmost position of FIG. 2, a slight amount of leftward shifting movement thereof will move the slide rib 46 to the FIG. 3 position. Here the rib underlies and flexes upwardly the extreme right hand end portion of washer 44; and the rib substantially underlies the right hand edge of the pin head 32. The right hand portion of washer 44 is now substantially wedged i.e., press-fitted or squeezed between the adjacent confronting portions of rib 46 and the under surface of the pin head 32. Hence, any further inadvertent leftward movement of the latching slide will be resisted by the so-wedged washer and the rib and pin head 32 between which the washer is wedged. In fact, any further leftward movement of the slide towards the middle position of FIG. 4 will increase the degree of such wedging and therefore will even more strongly resist such movement. However, if it is desired to move the slide to its opposite position, i.e., to its left-most position, sufficient manual force exerted on the upturned finger piece end 42 of the latching slide will push the slide through the center position of FIG. 4, through the further left hand intermediate position of FIG. 5, to the final leftmost shifted position of FIG. 6. Here, the latching slide will now be detentingly held against longitudinal shifting movement towards the right in the same way as described above but in a reverse manner.

The nylon or other like material of which the washer is made preferably has a surface characteristic which although sufficient to provide the wedging action described above, will not cause undue wear, as by grinding or abrasion, of the cooperating surface of the latching slide and the pin head 32, the slide and the pins usually being made of metal.

FIGS. 7 and 8 show the invention as applied to a looseleaf binder of the telescoping post type. Such types of binders are conventional and well known. They include binder posts 48 secured to one binder bar 50 fixed to the binder cover 14 and adapted to telescope with cooperable posts 52 fast with a removable bar 54. When the posts are in the assembled or telescoped condition shown in FIGS. 7 and 8, the latching rivets 22 extending from the outside face of bar 54 are adapted to be latched to the other side of the binder cover by latching slide 26 which is identical in construction and mode of operation with the latching bar 26 and detenting mechanism as described in connection with FIGS. 1 – 6.

In similar fashion, the novel mechanism of the present invention may be used in connection with any desired type of looseleaf binder mechanism.

While for illustrative purposes there has been shown and described in the present specification and drawings a preferred embodiment and preferred applications of the invention, it will be understood that the invention can be carried out in various other specific forms, and will find other applications. Accordingly, it is intended that the foregoing disclosure be illustrative only and not in any way limitative of the following claims.

I claim:

1. In a looseleaf binder including means for holding looseleaf paper, said paper holding means including a member adapted to be latched to a portion of said binder; latching means for so latching said member, said latching means including a latching member shiftable along a given path to and from respective latching and unlatching positions; mounting means for securing said latching member to said binder and mounting said latching member for said shiftable movement; said mounting means including a mounting member secured to said binder and extending in a direction transverse to said given path; and means for detenting said shiftable latching member in each of its two positions; said detenting means including:

a detent member separate from and movable relative to said latching member and mounted on said mounting member for movement therealong, in said transverse direction, relative to and towards and away from said latching member, said detent member comprising an annulus encircling said mounting member;

abutment stop means engageable by said detent member in the course of the latter's movement away from said latching member;

one of said detent member and said abutment stop means being of elastomeric material;

said latching member being provided with a protuberance protruding in said transverse direction and arranged to engage and move said detent member into engagement with said abutment stop means and hold said detent member in squeezed, press-fitted relationship with, by, and between said protuberance and said abutment stop means, in the course of the shifting movement of said latching member between its latching and unlatching positions.

2. The combination according to claim 1 wherein: said detent member is of an elastomeric material.

3. The combination according to claim 2 wherein: said abutment stop means is provided on said mounting member.

4. The combination according to claim 3 wherein: said mounting member comprises a pin.

5. The combination according to claim 4 wherein: said abutment stop means comprises an enlarged head on said pin.

6. The combination according to claim 2 wherein: said material is a synthetic resinous material.

7. The combination according to claim 6 wherein: said synthetic resinous material is nylon.

8. The combination according to claim 2 wherein: said mounting means comprises pin and slot means, said mounting member being the pin of said pin and slot means; said protruberance being provided intermediate the ends of said slot of said pin and slot means.

9. The combination according to claim 8 wherein: said protruberance comprises an elongated rib.

10. The combination according to claim 9 wherein: said annulus is a substantially flat washer.

11. The combination according to claim 2 wherein: said annulus is a substantially flat washer.

12. The combination according to claim 1 wherein: said annulus is a substantially flat washer.

* * * * *